US006464478B1

(12) United States Patent
Pedersen et al.

(10) Patent No.: US 6,464,478 B1
(45) Date of Patent: Oct. 15, 2002

(54) HYDRAULIC VANE MOTOR AND HYDRAULIC SYSTEM INCLUDING A HYDRAULIC VANE MOTOR

(76) Inventors: Håkon Sverre Pedersen, Kloppedalsveien 2, N-5043 Hop (NO); Eirik Næss, Orrebakken 5, N-5200 OS (NO)

( * ) Notice: Subject to any disclaimer, the term of this patent is extended or adjusted under 35 U.S.C. 154(b) by 0 days.

(21) Appl. No.: 09/346,866

(22) Filed: Jul. 2, 1999

(30) Foreign Application Priority Data

Jul. 20, 1998 (NO) ..... 983338

(51) Int. Cl.[7] ..... F04C 2/324
(52) U.S. Cl. ..... 418/15
(58) Field of Search ..... 60/489; 418/15, 418/259, 266

(56) References Cited

U.S. PATENT DOCUMENTS 2,221,308 A * 11/1940 Dischert ..... 60/489 X
2,639,855 A * 5/1953 Daniels ..... 418/15
4,088,426 A * 5/1978 Edwards ..... 418/15 X
4,464,101 A 8/1984 Shibuya
4,481,770 A * 11/1984 Lohbauer et al. ..... 60/489 X
4,557,674 A * 12/1985 Arnett, Jr. ..... 418/15
4,619,595 A * 10/1986 Amano et al. ..... 418/259 X
4,943,216 A * 7/1990 Iio ..... 418/15
5,056,993 A * 10/1991 Smith ..... 418/259
5,242,285 A 9/1993 Westermann, Jr.
5,431,552 A * 7/1995 Schuller et al. ..... 418/15 X

OTHER PUBLICATIONS

Patentstyret 19983338 dated Aug. 20, 2001 with a Sep. 2, 1988 letter from Hydraulic Brattvaag to Carrington Slipways Pty. Ltd. of Australia with materials and drawings relating to a motor with two ports.

Opposition Argument filed by Rolls–Royce AS, Brattvaag, dated Aug. 17, 2001.

* cited by examiner

*Primary Examiner*—John E. Ryznic
(74) *Attorney, Agent, or Firm*—Rodman & Rodman

(57) ABSTRACT

In a hydraulic vane motor having at least two working chambers (13, 14) and having flow in both directions, sealing strips (12), in a way that is known per se, are arranged loose in the respective vane slots (11) and are spring-loaded from the vane (11) towards the pathway (15). Each working chamber (13, 14) is provided with at least four ports (**16*a*, 16*b*) in the pathway (15). In addition to the ports, grooves (20, 21, 22**) are advantageously arranged parallel to the ports.

6 Claims, 3 Drawing Sheets

HYDRAULIC VANE MOTOR AND HYDRAULIC SYSTEM INCLUDING A HYDRAULIC VANE MOTOR

BACKGROUND OF THE INVENTION

In the offshore sector in particular, there is a growing need for winches of considerable capacity. Low pressure hydraulics, including hydraulic van motors, have been found in practice to be highly suitable for this purpose.

Of particular interest are multi-motor systems, which include a number of torque/velocity stages, and dynamic braking effects many times greater than the installed pumping effect.

However, it is a fact that component size, pipe size and weight can be highly unwieldy when capacities are large. There is therefore a need for an increase in both working pressure and motor drive speed, without any reduction in operational safety and without any increase in the noise level.

It is known that for a low pressure multi-chamber motor, the rotor ought to be as broad as possible, for example, 80–90° of the rotor diameter, in order to obtain optimal stroke volume.

In existing hydraulic vane motors of the said type, the ports in the pathway are positioned so as to be axially centric. The width of the port is normally about 30% of the width of the pathway. The width of the port should be as small as possible on account of the contact face of the vanes against the pathway. On the other hand, the width of the port should be as large as possible on account of the flow conditions in the motor. When a vane starts to enter a working chamber in the motor, the oil volume, having an approximately triangular cross-section behind the vane, must be refilled with oil. The oil velocity from the port and out towards the sides through the gap having an approximately triangular cross-section, is relatively high, with a correspondingly large pressure drop and noise as a result. When a vane starts to exit a working chamber, the reverse will happen, namely that the "triangular volume" in front of the vane must be evacuated relatively quickly from the sides and in towards the port, with corresponding pressure rise and noise as a result. When the motor is driven by the load as a pump, conditions will be considerably worsened. When a vane enters the working chamber, the "triangular volume" behind the vane must be refilled with oil from the port and out towards the sides. The oil velocity from the port and out towards the sides through the gap having an approximately triangular cross-section will be relatively high, with a correspondingly large pressure drop. The danger of cavitation and noise then increases dramatically, even though the motor is fed at a relatively high filling pressure. When a vane exits the chamber, the "triangular volume" in front of the vane must be evacuated very quickly, with local rise in pressure as a result.

In order to reduce the fall in pressure or the local build-up of pressure in the "triangular volume", it is known to mill two grooves in the pathway parallel to the respective port. To prevent cavitation, especially when the motor functions as a brake, the width and number of the grooves must be relatively large in order to produce the desired effect. The contact face of the vanes will then be reduced correspondingly.

Of course, the abutment and sealing of the vanes against the pathway are of importance. The known solution which results in by far the greatest reduction of noise, is to use "vane in the vane". Accordingly a loose sealing strip is provided on the top of the vane in the vane slot. Relatively weak springs mounted in the vane hold the sealing strip against the pathway. As the vane moves towards the largest radius of the working chamber, the springs will move the sealing strip into sealing position prior to the vane taking over the torque transmission. So-called "through strokes" will therefore be virtually eliminated. In this known solution, deformations and sealing strip wear are compensated for.

The sealing strips are of low-friction synthetic material, with relatively small mass forces. A disadvantage of using such "loose sealing strips" on the vane top is that the material of the sealing strip has a relatively low modulus of elasticity which gives the sealing strip limited rigidity. In particular when the sealing strips pass the axially centric ports, the sealing strips may "fish" in the ports.

OBJECTS AND SUMMARY OF THE INVENTION

The object of the present invention is to provide a hydraulic vane motor of great capacity. The considerable capacity is provided by increasing working pressure and motor drive speed, but without causing any increase in the noise level.

This object is achieved according to the invention with a hydraulic vane motor as mentioned above, characterised in that sealing strips, in a way that is known per se, are provided loose in the respective vane slot and are spring-loaded from the vane towards the pathway, and that each working chamber is provided with at least four ports in the pathway.

The invention contains the possibility of having the broadest possible rotor relative to rotor diameter, with the attainment of optimal stroke volume. Optimal stroke volume means: optimal torque with minimum weight at a given pressure.

A broadest possible rotor gives a minimum rotor diameter at a given stroke volume.

Since the peripheral speed of the rotor is a limiting parameter as regards the motor drive speed, a minimum rotor diameter will in theory also permit optimal motor drive speed. However, the internal flow conditions in the motor are worsened as the rotor width increases relative to the rotor diameter.

Since the motor according to the invention is provided with at least four ports for each working chamber, in practice two relatively narrow ports instead of only one axially centric port, the internal flow conditions in the motor are dramatically improved.

The embodiment with at least four ports for each of the motor working chambers also means that the support of the loose sealing strips against the pathway is dramatically improved. The motor drive speed can therefore be increased. Since, as already mentioned, the loose sealing strips are the known solution which gives by far the greatest reduction in noise, the pressure can be increased.

According to the invention, it is advantageous if, parallel with the two narrow ports, three grooves can be milled, one groove in an axially centric position, and two grooves at the edges of the pathway, so as to further improve the flow conditions. This means that a motor having a rotor of maximum width in relation to rotor diameter may also be driven with optimum drive speed, i.e., optimal output.

The invention also comprises a hydraulic system including a hydraulic vane motor having at least two working chambers and having flow in both directions, which vane motor includes a rotor having vane slots and vanes in the vane slots, and wherein each working chamber has a port-equipped pathway against which the vanes run; a pump which supplies a hydraulic working medium for operation of the vane motor; a control valve for controlling the drive speed and direction of rotation of the vane motor; a sequence valve for selection of active working chambers; a pressure reducing valve coupled in series relation to the pump; and a double-acting pressure relief valve coupled in parallel relation to the motor, and what characterises the hydraulic system according to the invention is that sealing strips, in a way that is known per se, are arranged loose in the respective vane slot and are spring-loaded from the vane towards the pathway, and that each working chamber is provided with at least four ports in the pathway.

A hydraulic system of this kind is particularly favourable. In this connection, reference is made to NO-PS 154 491, which teaches and describes a hydraulic system as presumed known here. NO-PS 154 491 relates to multi-motor systems having a number of torque/velocity stages and dynamic braking effect many times greater than installed pumping effect. The apparatus according to the invention could to advantage be used in a system of this kind.

In addition, reference shall be made to NO-PS 163 892, which also teaches and describes a hydraulic system, chiefly for the operation of winches.

DESCRIPTION OF THE DRAWINGS

The invention will now be described with reference to the drawings, wherein.

DETAILED DESCRIPTION

Figure 1:
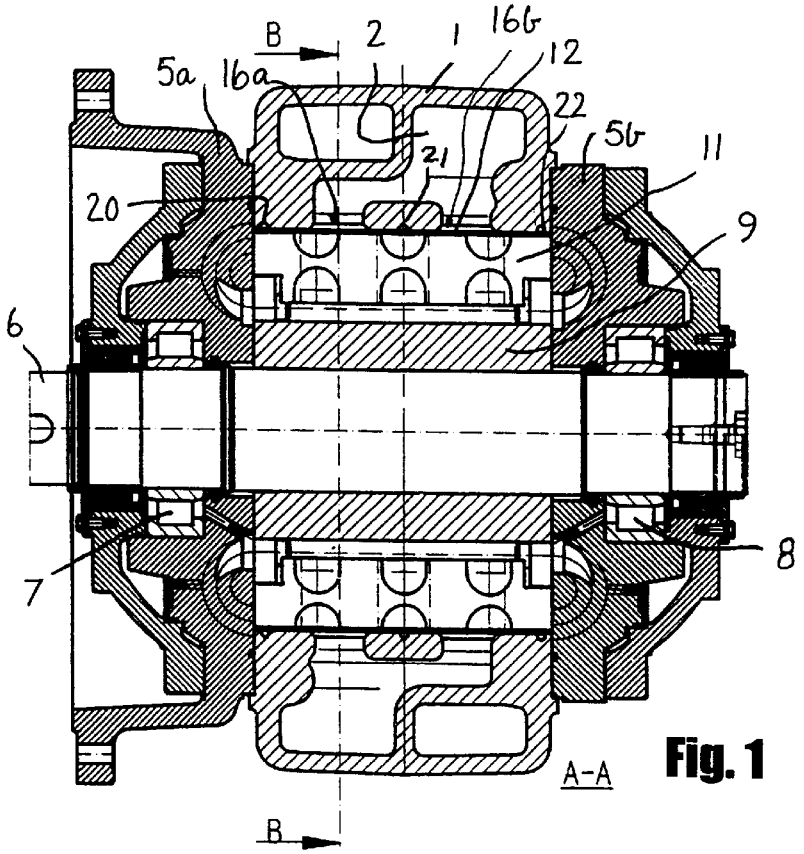
FIG. 1 shows a longitudinal section through a hydraulic vane motor according to the invention, taken along the line A—A in FIG. 2.
Figure 2:
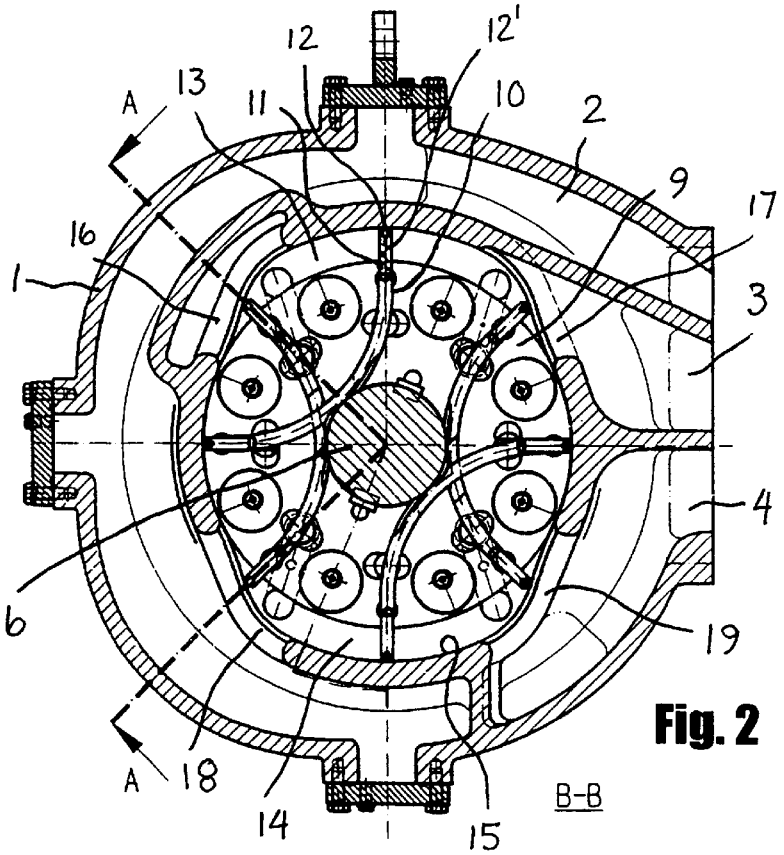
FIG. 2 shows a cross section of the hydraulic vane motor taken along the line B—B in FIG. 1.
Figure 3:
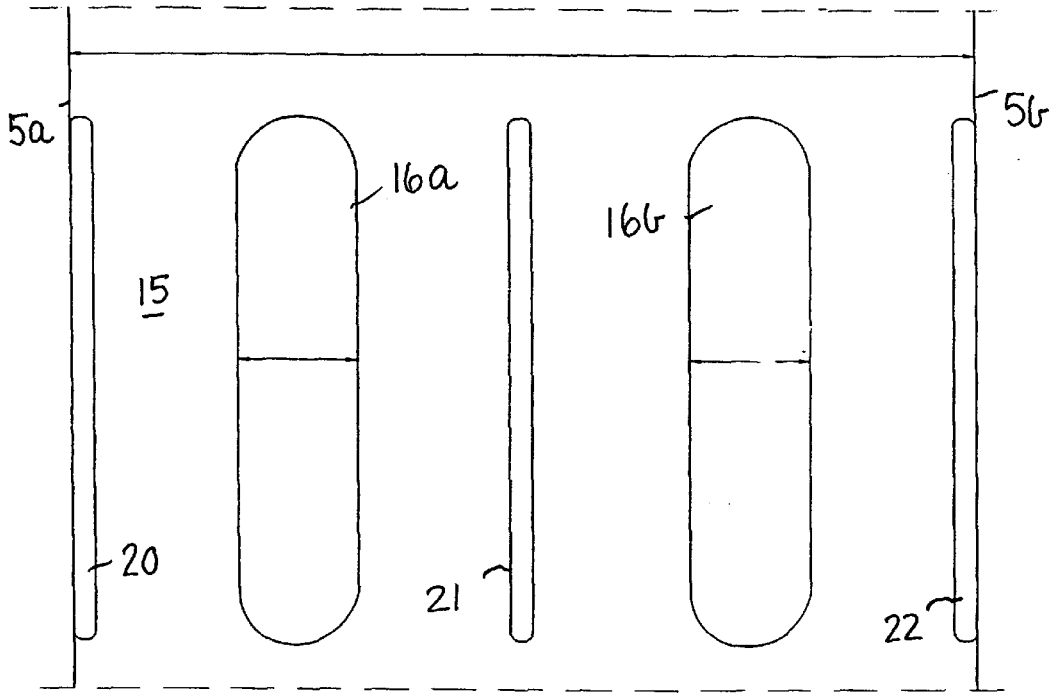
FIG. 3 shows a port and groove arrangement according to the invention.

The new hydraulic vane motor shown in FIGS. 1, 2 and 3 is in the main designed and constructed in a way that is known per se. Thus, the hydraulic vane motor includes a motor housing 1 having ducts 2, 3, 4 and two side covers 5*a*, 5*b*. A motor shaft 6 is rotatably supported in the side covers 5*a*, 5*b* in suitable roller bearings 7, 8. On the shaft 6 is a rotor 9, which has vane slots 10 with vanes 11 arranged therein and having spring-loaded 12' sealing strips 12.

The motor has two working chambers 13, 14.

The vanes 11 and their sealing strips 12 run against a pathway 15 in the motor housing 1. Each working chamber 13, 14 has ports 16, 17 and 18, 19.

According to the invention, the hydraulic vane motor has at least four ports for each working chamber, and a typical port arrangement is shown in FIG. 3.

As shown, two relatively narrow ports 16*a*, 16*b* are arranged across the width of the pathway (between the side caps 5*a*, 5*b*) in FIG. 3 instead of only one axially centric port as previously known. The use of two such narrow ports 16*a*, 16*b* results in a dramatic improvement in the internal flow conditions in the motor. For further improvement of the flow conditions three milled-out grooves 20, 21, 22 are shown in FIG. 3, one axially centric groove 21, and two grooves 20, 22 at the edges of the pathway, all the grooves being arranged parallel with the two ports 16*a*, 16*b*.

The embodiment shown in FIG. 3 means that a motor having broadest possible rotor relative to rotor diameter is also capable of being driven with optimal drive speed, i.e., optimal output.

Figure 4:
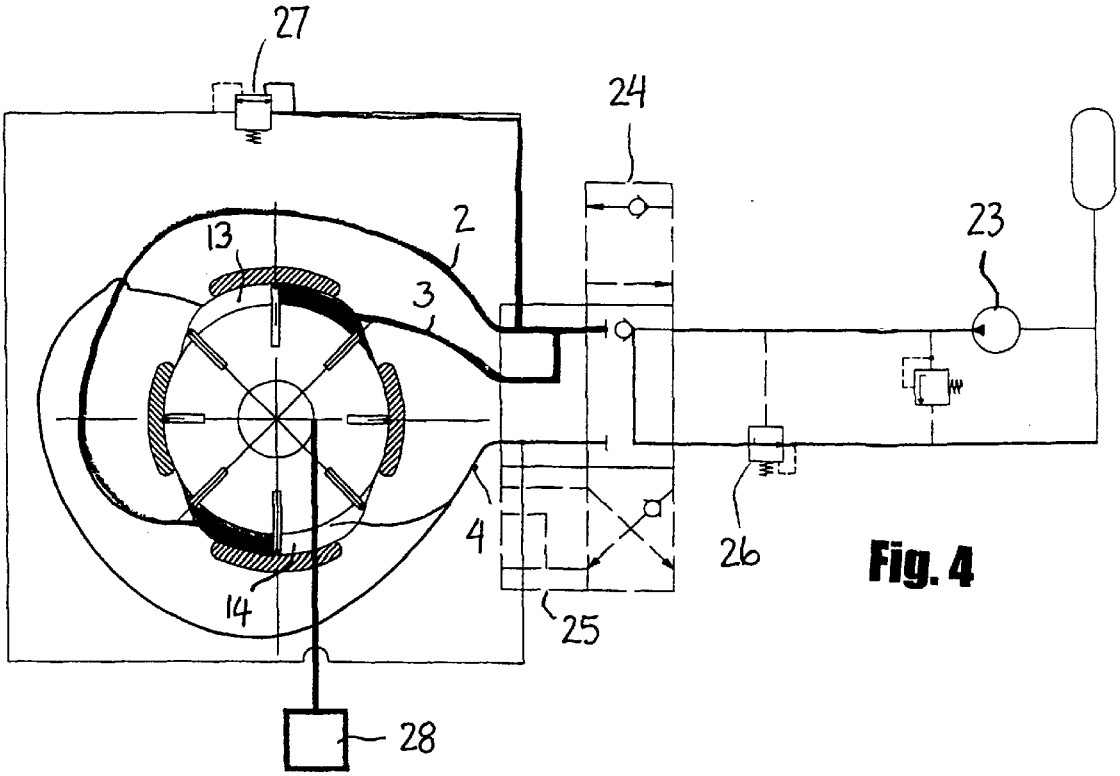
FIG. 4 shows a hydraulic system wherein the invention has been implemented.
Figure 5:
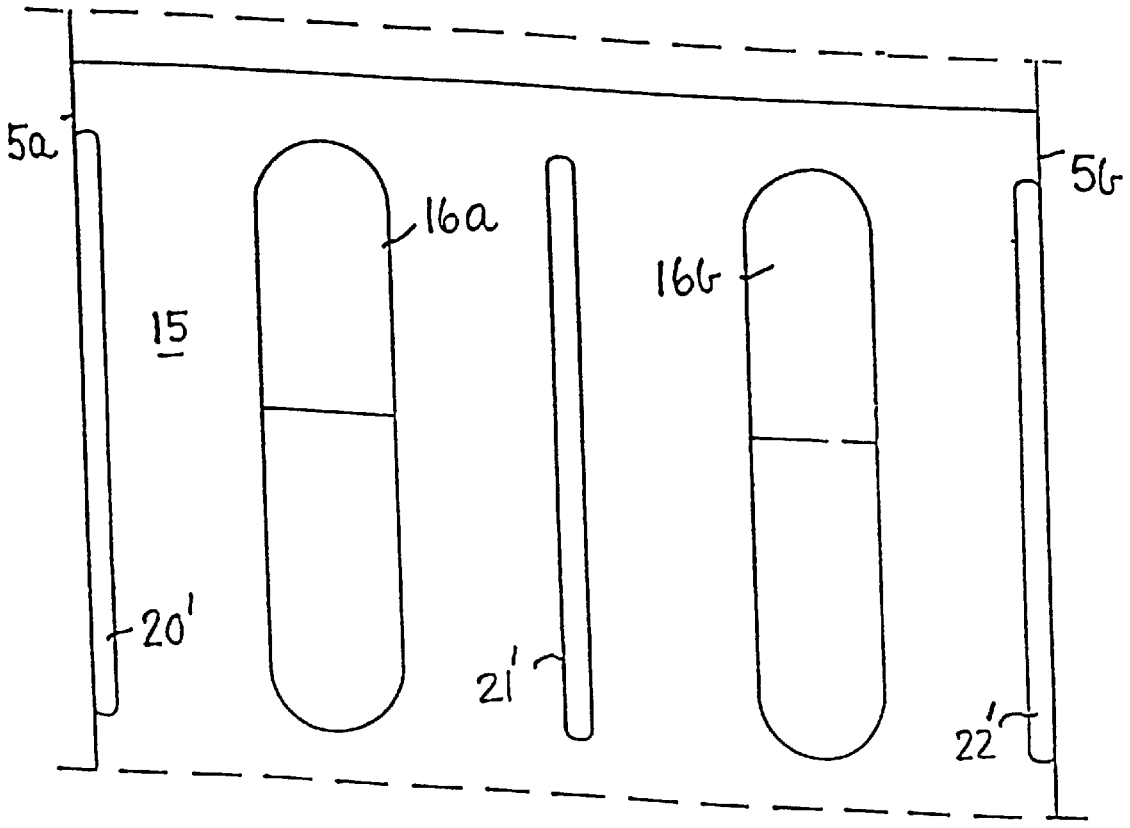
FIG. 5 shows a port and groove arrangement corresponding to that shown in FIG. 3 including the additional three grooves of the chamber of the motor.

FIG. 4 shows how the invention can be implemented in a hydraulic system. The hydraulic system shown in FIG. 4 includes a hydraulic vane motor, for example, as shown in FIGS. 1–3. The systems also includes a pump 23, a control valve 24 for controlling the drive speed and direction of rotation of the vane motor, a sequence valve 25 for selection of active working chambers 13, 14, a pressure reducing valve 26 coupled in series relation to the pump, and a double-acting pressure relief valve 27 coupled in parallel relation to the motor.

The hydraulic system is FIG. 4 is shown when at a standstill. A weight rectangle 28 symbolises a load in a non-illustrated winch which the hydraulic motor is used to operate. With the aid of the valves 24, 25, the illustrated hydraulic system can be adjusted for hoisting and lowering by using one or two chambers, with a clockwise or anti-clockwise direction of rotation. The blocking oil stream is indicated in thick lines in FIG. 4.

What is claimed is:

1. A hydraulic vane motor having at least two working chambers (13, 14) and having flow in both directions, including a rotor (9) having vane slots (10) and vanes (11) in the vane slots, each working chamber (13, 14) having a port-equipped pathway (15) against which the vanes run, sealing strips (12) being loosely arranged in said vane slots (10) and are spring-loaded from the vane (11) against the pathway 15, and that each working chamber (13, 14) is provided with at least four ports (16*a*, 16*b*) in the pathway (15), characterised in that each working chamber (13, 14) is provided with at least six grooves (20, 21, 22) in the pathway (15), parallel to the ports (16*a*, 16*b*).

2. A hydraulic vane motor according to claim 1, characterised in that one groove (21) is arranged so as to be axially centric, and two grooves (20, 22) are arranged at the edges of the pathway (15).

3. A hydraulic system including a hydraulic vane motor having at least two working chambers (13, 14) and having flow in both directions, including a rotor (9) having vane slots (10) and vanes (11) in the vane slots, and wherein each working chamber (13, 14) has a port-equipped pathway (15) against which the vanes run; a pump (23) which supplies a hydraulic working medium for operation of the vane motor; a control valve (24) for controlling the drive speed and direction of rotation of the vane motor; a sequence valve (25) for selection of active working chambers (13, 14); a pressure reducing valve (26) coupled in series relation to the pump (23); and a double-acting pressure relief valve (27) coupled in parallel relation to the motor, sealing strips (12) being loosely arranged in said vane slots (10) and are spring-loaded from the vane (11) against the pathway (15), and in that each working chamber (13, 14) is provided with at least four ports (16*a*, 16*b*) in the pathway (15), characterised in that each working chamber (13, 14) is provided with at least six grooves (20, 21, 22) in the pathway (15), parallel to the ports (16*a*, 16*b*).

4. A hydraulic system according to claim 3, characterised in that one groove (21) is arranged so as to be axially centric and two grooves (20, 22) are arranged at the edges of the pathway (15).

5. A hydraulic system including a hydraulic vane motor having at least two working chambers (13, 14) and having flow in both directions, a pump (23) which supplies a hydraulic working medium for operation of the motor; a control valve for controlling the drive speed and direction of rotation of the motor; a sequence valve (29) for selection of active working chambers (13, 14), a pressure reducing valve (26) coupled in series relation to the pump, and a double-acting pressure relief valve (27) coupled in parallel relation to the motor, sealing strips (12) being loosely arranged in said vane slots (10) are spring-loaded from the vane (11) against a port-equipped pathway (19), and in that each working chamber (13, 14) in the motor being provided with at least four ports (16*a*, 16*b*) in the in the pathway (15), characterised in that for each working chamber (13, 14) in the motor at least six grooves (20, 21, 22) are arranged in the pathway (15), parallel to the at least four ports (16*a*, 16*b*) of the working chamber.

6. A system according to claim 5, characterised in that one groove (21) is arranged so as to be axially centric and two grooves (20, 21) are arranged at the edges of the pathway.

* * * * *